US005341925A

United States Patent [19]

Fleenor et al.

[11] Patent Number: 5,341,925

[45] Date of Patent: Aug. 30, 1994

[54] CIGARETTE HARDPACK HAVING ROUNDED CORNERS AND LID RETAINING FLAPS

[75] Inventors: J. Jerome Fleenor, Midlothian; Duane C. Wilder, Chesterfield, both of Va.

[73] Assignee: Philip Morris Incorporated, New York, N.Y.

[21] Appl. No.: 99,324

[22] Filed: Jul. 30, 1993

[51] Int. Cl.[5] ..... B65D 85/10

[52] U.S. Cl. ..... 206/268; 229/160.1

[58] Field of Search ..... 206/268, 271, 273; 229/160.1

[56] References Cited

U.S. PATENT DOCUMENTS

| | | | |
|---|---|---|---|
| 4,216,898 | 8/1980 | Davies | 206/273 |
| 4,753,383 | 6/1988 | Focke et al. . | |
| 4,753,384 | 6/1988 | Focke et al. | 206/273 |
| 4,852,734 | 8/1989 | Allen et al. | 206/273 |
| 5,044,550 | 9/1991 | Lamm | 206/268 |

*Primary Examiner*—Jimmy G. Foster

*Attorney, Agent, or Firm*—Burns, Doane, Swecker & Mathis

[57] ABSTRACT

A cigarette pack includes a pack portion and a lid portion hinged thereto, and an inner frame disposed within the pack portion and projecting upwardly beyond an upper end of the pack portion. The vertical corners of the cigarette pack are smoothly rounded. Front rounded corners of the inner frame are formed with integral retention flaps which project laterally outwardly so as to bear frictionally against the sidewalls of the lid portion when the lid portion is in a closed state. Each sidewall of the lid portion includes inner and outer panels. The inner panel includes a front edge located behind the respective retention flap so as to avoid making contact therewith when the lid is pivoted between open and closed states.

3 Claims, 2 Drawing Sheets

CIGARETTE HARDPACK HAVING ROUNDED CORNERS AND LID RETAINING FLAPS

BACKGROUND OF THE INVENTION

The present invention relates to paperboard containers having a hinged lid.

Paperboard containers having hinged lids are conventional, such as so-called cigarette hard packs, as disclosed for example, in Focke et al U.S. Pat. No. 4,753,383, and which is depicted in the accompanying FIGS. 3–5. That container, designed to hold cigarettes, is erected from a cardboard blank to form a pack portion 6 and a lid 8 integrally hinged to the pack portion. A separate inner frame 10 is glued within the pack portion and projects beyond an upper edge thereof. The four vertical corners 12 of the container are of a rounded configuration. In order to provide sufficient friction between the pack portion and lid to keep the lid closed, the pack portion includes a pair of retention flaps 14 extending along the front corners 12 of the base.

Each retention flap 14 is formed by making a cut in a front corner of the inner frame such that the flap projects laterally beyond the corner. Outer edges 19 of those retention flaps are intended to bear against the inner faces of side walls 18 of the lid 8 to frictionally retain the lid in a fully closed condition. Each side wall 18 of the lid is comprised of outer and inner panels 20, 22 lying against one another. According to the disclosure of that patent, a front edge 24 of the inner panel engages behind the respective flap 14 so as to stress the latter toward a position in which the flap is projected laterally outwardly.

It has been observed that the outer edges 19 of the flaps, after a short period of use, become frayed which is undesirable from at least an aesthetic standpoint. That fraying is especially undesirable if the pack is of a type in which the flaps are overlaid with an outer foil layer of decorative (e.g., colored) material, because the fraying can result in a delamination of the foil layer.

The present inventor has realized that the fraying of the flap edge 19 is caused when a sharp corner defined by a lower end 26 of the front edge 24 (depicted in FIG. 5) rubs across the flap outer edge 19 each time that the lid 8 is opened and closed. That rubbing quickly causes a fraying and/or delamination of the retaining flaps.

SUMMARY OF THE INVENTION

The above discussed shortcomings are obviated by the present invention which relates to a cigarette hardpack comprising a pack portion and a lid portion formed of one piece with the pack portion and being pivotable relatively thereto about a rear hinged axis. An inner frame is disposed in the pack portion and projects upwardly beyond an upper end thereof so as to be opened and closed by the lid portion. The pack and lid portions include rounded vertical front corners. The inner frame includes rounded front corners mating with the front corners of the pack and lid portions. The lid portion includes a pair of sidewalls comprised of interengaged inner and outer panels. Each of the front corners of the inner frame includes a retention flap formed of one piece therewith and extending laterally outwardly so that an outer end of the retention flap bears frictionally against an inner face of an outer panel of a respective sidewall when the lid is in a closed state. Each inner panel includes intersecting front and bottom edges. The front edge is disposed behind a respective retention flap and sufficiently distant therefrom that the front edge avoids making contact with the retention flap during opening and closing of the lid portion.

BRIEF DESCRIPTION OF THE DRAWINGS

The objects and advantages of the invention will become apparent from the following detailed description of a preferred embodiment thereof, in connection with the accompanying drawings in which like numerals designate like elements and in which.

DETAILED DESCRIPTION OF A PREFERRED EMBODIMENT OF THE INVENTION

Figure 2:
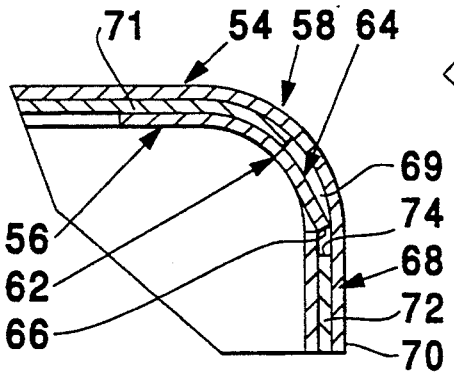
FIG. 2 is a sectional view taken along the line 2—2 in FIG. 1.

A cigarette hardpack 50 according to the present invention comprises a pack portion 52 and an integral hinge 54 formed from a paper blank such as cardboard. An inner frame 56, also formed of paper, is glued within the pack portion so as to project upwardly beyond an upper end of the pack portion in the usual manner. Note that a portion of the lid has been broken away in FIG. 1 to expose the inner frame 56. The pack portion 52 and lid 54 are configured to present two rounded vertical front corners 58 and two rounded vertical rear corners 60. The inner frame 65 is configured with rounded corners 62 (only one being depicted) which mate with the front corners 58 of the pack portion and lid.

Figure 1:
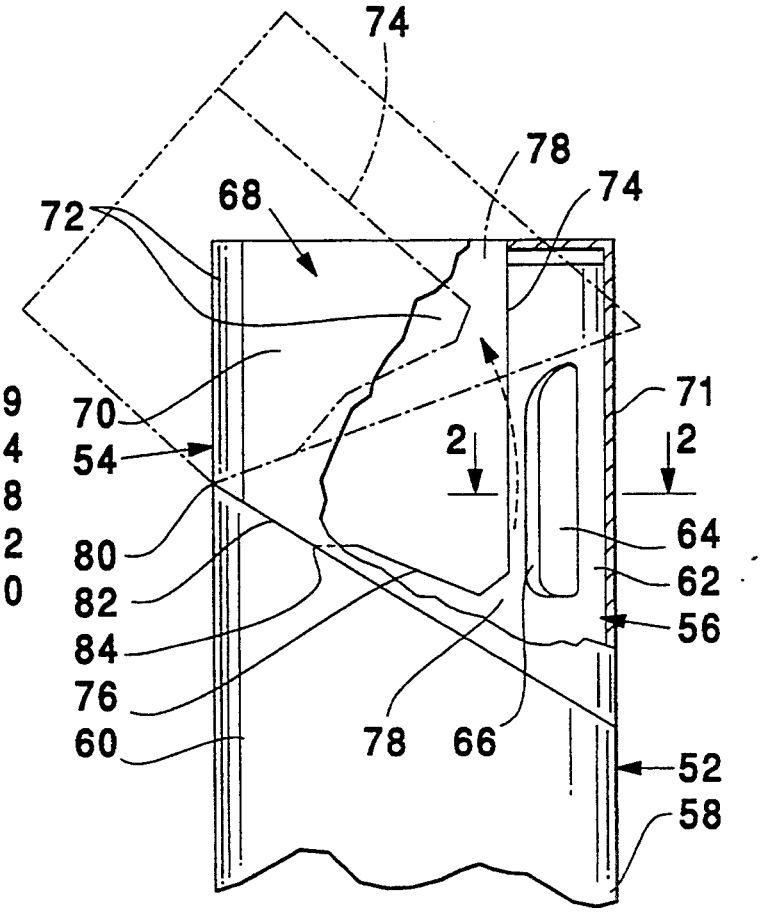
FIG. 1 is a side elevational view of an upper portion of a cigarette pack according to the present invention, with a portion of an outer panel of a lid sidewall being broken away to expose an inner panel and a retention flap.
Figure 3:
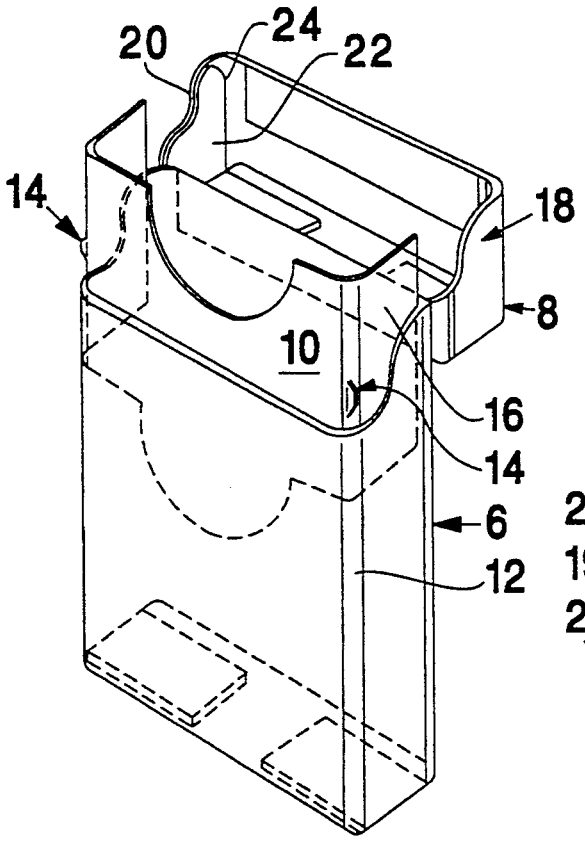
(PRIOR ART) FIG.3
FIG. 3 is a top perspective view of a prior art cigarette pack with a lid portion thereof in an opened state.
Figure 4:
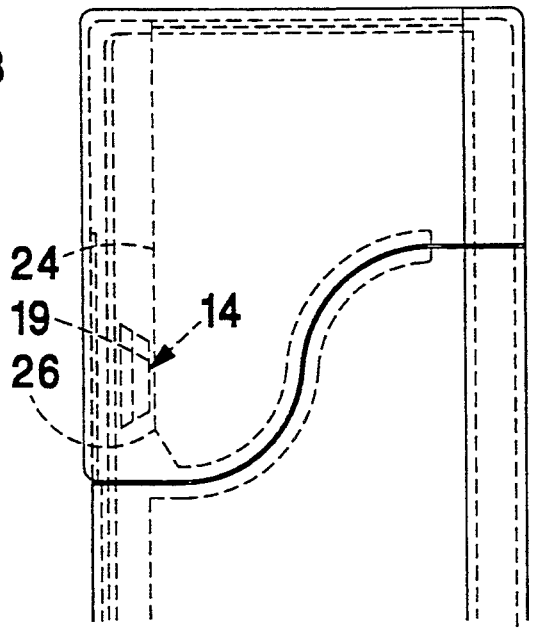
(PRIOR ART) FIG.4
FIG. 4 is a side elevational view of an upper portion of the cigarette pack depicted in FIG. 3, with the lid portion in a fully closed state.
Figure 5:
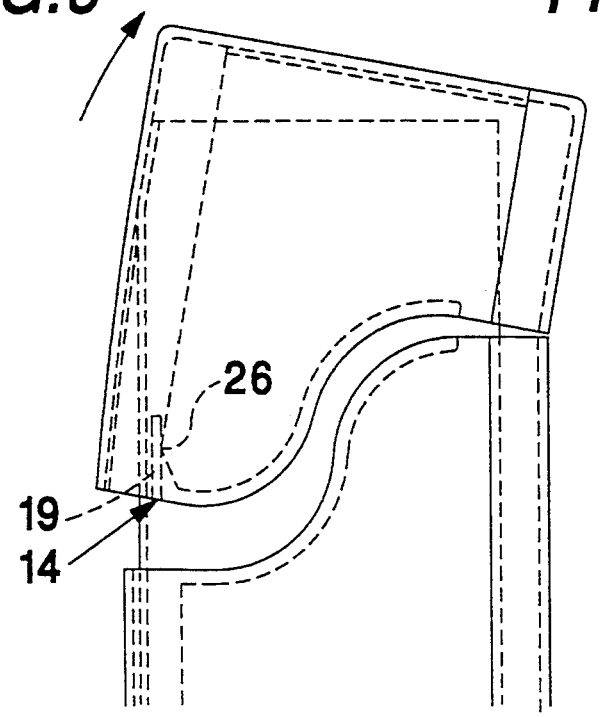
(PRIOR ART) FIG.5
FIG. 5 is a view similar to FIG. 4 as the lid portion is in the process of being pivoted to an opened state.

Although only one vertical front corner of the pack is depicted in FIGS. 1 and 2, it will be understood that the other vertical front corner is of identical configuration.

The inner frame 56 includes a pair of identical retention flaps 64 (only one being depicted) formed by slits made in respective corners 62. Each retention flap extends laterally outwardly so that an outer edge 66 thereof bears frictionally against an inner face of a respective side wall 68 of the lid 54 when the lid is closed, in order to retain the flap in a fully closed state. When the lid 54 is closed, a void area 69 is formed between each retention flap 64 and the lid in front of the retention flap, as shown in FIG. 2.

Each side wall 68 comprises outer and inner panels 70, 72 lying against one another and held together by adhesive. The outer panel 70 is integral with a portion 71 of the blank which forms a front panel of the lid. Intersecting regions between the panels 70, 71 define the rounded corners 58.

The inner panel 72 includes front and lower edges 74, 76 which intersect one another to form a corner 78. The front edge 74 is spaced rearwardly of the respective retention flap 64 by a sufficient distance to ensure that the front edge 74, including the corner 78 avoids making contact with the retention flap 64 during pivoting of the lid about a hinge axis 80 between an open state (shown in dash-dot lines in FIG. 1) and a closed state (shown in solid lines in FIG. 1). Dashed lines in FIG. 1 depict the path of travel of the corner 78 during pivoting of the lid.

In order to minimize the length of the pivoting radius of the corner 78 (i.e., the distance from the hinge axis 80 to the corner 78), the bottom edge 76 of the inner panel 72 deviates vertically with respect to a bottom edge 82 of the outer panel 70, beginning at a location 84 located intermediate the hinge axis 80 and the corner 78. By thus raising the location of the corner 78 with respect to the bottom edge 82 of the panel 70, the length of the pivot radius is reduced. (That pivot radius is at a minimum when located at the same elevation as the hinge axis 80.) Preferably, the corner 78 is located at an elevation between the bottom edge 82 and the hinge axis 80.

It will be appreciated that in accordance with the invention, opening and closing of the lid 54 will not result in a fraying or delamination at the outer edges 66 of the retention flaps 64, because the front edges 74 of the inner panels 72 of the lid side walls will not contact the retention flaps 64.

Although the present invention has been described in connection with a preferred embodiment thereof, it will be appreciated by those skilled in the art that additions, deletions, modifications, and substitutions not specifically described may be made without departing from the spirit and scope of the invention as defined in the appended claims.

What is claimed is:

1. A cigarette hard pack comprising a pack portion and a lid portion formed of one piece with said pack portion and pivotable relative thereto about a rear hinge axis, an inner frame disposed in said pack portion and projecting upwardly beyond an upper end thereof so as to be opened and closed by said lid portion, said pack and lid portions including rounded vertical front corners, and said inner frame including rounded vertical front corners mating with said front corners of said pack and lid portions, said lid portion including a pair of side walls comprised of interengaged inner and outer panels, each of said front corners of said inner frame including a retention flap formed of one piece therewith and extending laterally outwardly so that an outer end of said retention flap bears frictionally against an inner face of an outer panel of a respective side wall when said lid is in a closed state, each inner panel including intersecting front and bottom edges, said front edge disposed behind a respective retention flap and sufficiently distant therefrom that said front edge avoids making contact with the retention flap during opening and closing of said lid portion.

2. A cigarette pack according to claim 1, wherein said bottom edge of said inner panel including a front portion deviating upwardly with respect to a front portion of said outer panel, said deviation beginning at a location spaced closer to said hinge axis than to a place of intersection of said front and bottom edges of said inner panel.

3. A cigarette pack according to claim 2, wherein said front and bottom edges of said inner panel intersect to form a sharp corner.

* * * * *